US005505129A

United States Patent [19]

Greb et al.

[11] Patent Number: 5,505,129

[45] Date of Patent: Apr. 9, 1996

[54] WEB WIDTH TRACKING

[75] Inventors: Ronald E. Greb, Burnaby; George E. Ilott, Richmond, both of Canada

[73] Assignee: MacMillan Bloedel Limited, Vancouver, Canada

[21] Appl. No.: 433,117

[22] Filed: May 3, 1995

[51] Int. Cl.[6] ..... B41F 5/04

[52] U.S. Cl. ..... 101/219; 101/248; 101/484; 101/151; 364/563; 250/559.29; 250/559.36; 226/27; 226/45

[58] Field of Search ..... 101/226, 219, 101/247, 248, 219, 484; 226/27, 45; 242/57, 57.1; 364/554, 560, 561, 563; 250/548, 559.29, 559.36

[56] References Cited

U.S. PATENT DOCUMENTS

| | | | |
|---|---|---|---|
| 4,235,358 | 11/1980 | Klein | 226/22 |
| 4,381,586 | 5/1983 | Abler | 226/42 |
| 4,500,045 | 2/1985 | Whitaker et al. | 242/57.1 |
| 4,569,584 | 2/1986 | St. John et al. | 101/151 |
| 4,760,626 | 8/1988 | Lönner et al. | 226/20 |
| 4,859,860 | 8/1989 | Poterala | 250/548 |
| 4,888,717 | 12/1989 | Ditto et al. | 364/563 |
| 4,991,761 | 2/1991 | Gnuechtel et al. | 226/15 |
| 5,345,863 | 9/1994 | Kurata et al. | 226/45 |
| 5,394,223 | 2/1995 | Hart et al. | 355/212 |

*Primary Examiner*—Eugene H. Eickholt
*Attorney, Agent, or Firm*—C. A. Rowley

[57] ABSTRACT

A printing system having a plurality of printing stations in series is provided with a web width sensor system that detects the change in width of a paper web by monitoring the position of both edges of the sheet after it leaves a printing station to determine the change in position of each side edge and thereby the change in width of the web.

4 Claims, 3 Drawing Sheets

WEB WIDTH TRACKING

FIELD OF INVENTION

The present invention relates to web width measurement, more specifically, the present invention relates to a width measuring system to determine the change of width of a web as it passes through a multi-station printing press.

BACKGROUND OF THE INVENTION

In printing presses, the paper web being printed is subjected to the application of water and/or ink that absorbs into the paper and produces a size change in the paper. This change in size occurs both longitudinally (machine direction (MD)) and width wise (cross machine direction CD)) of the web. Dimensional changes caused in each printing station must be accommodated in the next printing station to ensure print registration, i.e. when multicolored printing is being performed, expansion may cause some misregister of subsequently applied colors. This misregistration in the machine direction is currently compensated for by adjusting the web tension and in effect, jogging selected printing station(s) when significant longitudinal misregister is detected. Lateral or width wise misregister due to CD dimension changes as the web passes through the press is more difficult to accommodate, as prior to the present invention, the concept of measuring and how to measure the CD dimensional change was not available. Techniques for adjusting for CD expansion were based solely on examination of the printed copy and generally, subjectively judging the misregistration.

Correction of lateral (width wise) misregistration is a matter of trial and error and is difficult to compensate for as subjective assessment must be translated into specific action.

Also, every time the pattern to be printed is changed or the paper to be printed on is changed, the amount of liquid (water) absorbed is changed and the amount of expansion changes.

It is known to detect an edge of a traveling web using a laser beam by monitoring the portion of the laser beam either beyond the edge of the web or blocked by the edge of the web.

It is also known to sense the thickness of elements and/or the width of narrow tapes or the like of less width than the length of a laser line used in the sensor. Sensing the location of opposite ends of a board using reflecting laser beams and then determining the width of the board is also known.

BRIEF DESCRIPTION OF THE PRESENT INVENTION

It is an object of the present invention to provide a web sensor for determining the change in width of a web after it passes through an operating (printing) station where it is subject to liquid pick-up such as water which causes expansion.

Broadly, the present invention relates to a multi-station printing system wherein a web being printed passes through a plurality of printing stations arranged in series and wherein said web passing through said stations changes dimensions when subject to a printing operation in each said station, comprising at least one sensor station including a first and a second side edge sensor, means mounting said first side edge sensor on an output side of a first of said printing stations in a position to detect the location of a first side edge of said web relative to a datum as said web travels past said first side edge sensor, means mounting said second side edge sensor on said output side of said first printing station in a position to detect the location of a second side edge of said web relative to a second datum, said second side edge being on the opposite side of said web from said first side edge and means for determining the change in width of said web after it has been printed on in said first printing station based on said sensed locations of said first and said second side edges of said web.

Preferably, said change in width relative to said datum will be determined by adding the components of change in width sensed by said first and said second sensors relative to said datum and said second datum with an increase in web width relative to said datum being positive.

Preferably, one of said sensing stations will be provided following each of a plurality of said printing station of said series of printing stations to determine the change of width of said web after each said printing station of said plurality of printing stations.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
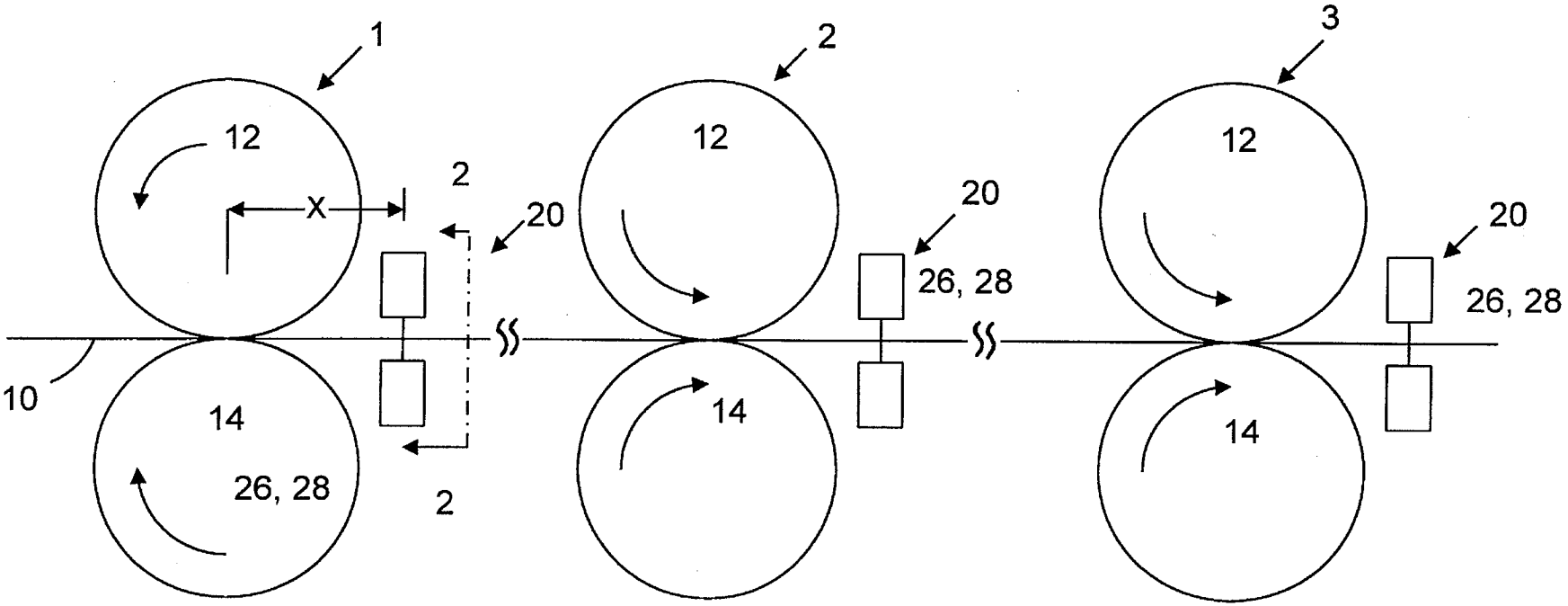
FIG. 1 is a schematic side elevation of a printing press with a plurality of printing stations arranged in series and incorporating the present invention.

FIG. 1 schematically shows the present invention with web width sensors applied at several stages in a printing operation wherein web 10 passes through a series of printing stations schematically indicated at 1, 2 and 3. Each of the printing stations is represented by a pair of rolls 12 and 14 which form a nip. Obviously, this representation of a printing station is a great over simplification, however, for the purposes of the present invention, it is sufficient to indicate that printing is generally an offset printing process wherein water (and ink) is applied to the paper. This addition of water, in particular, causes the fibers in the paper web to expand so that the web leaving say the printing station 1 (or 2, or 3, etc.) has a different dimension (width) than the width of the paper web entering printing station 1 (or 2, or 3, etc.).

These changes in web width are measured by a web width sensor 20 shown interposed between each of the stations 1 and 2, 2 and 3 and following sending station 3. All of these web width sensors are essentially the same and are shown in more detail in FIG. 2.

Figures 2, 2A:
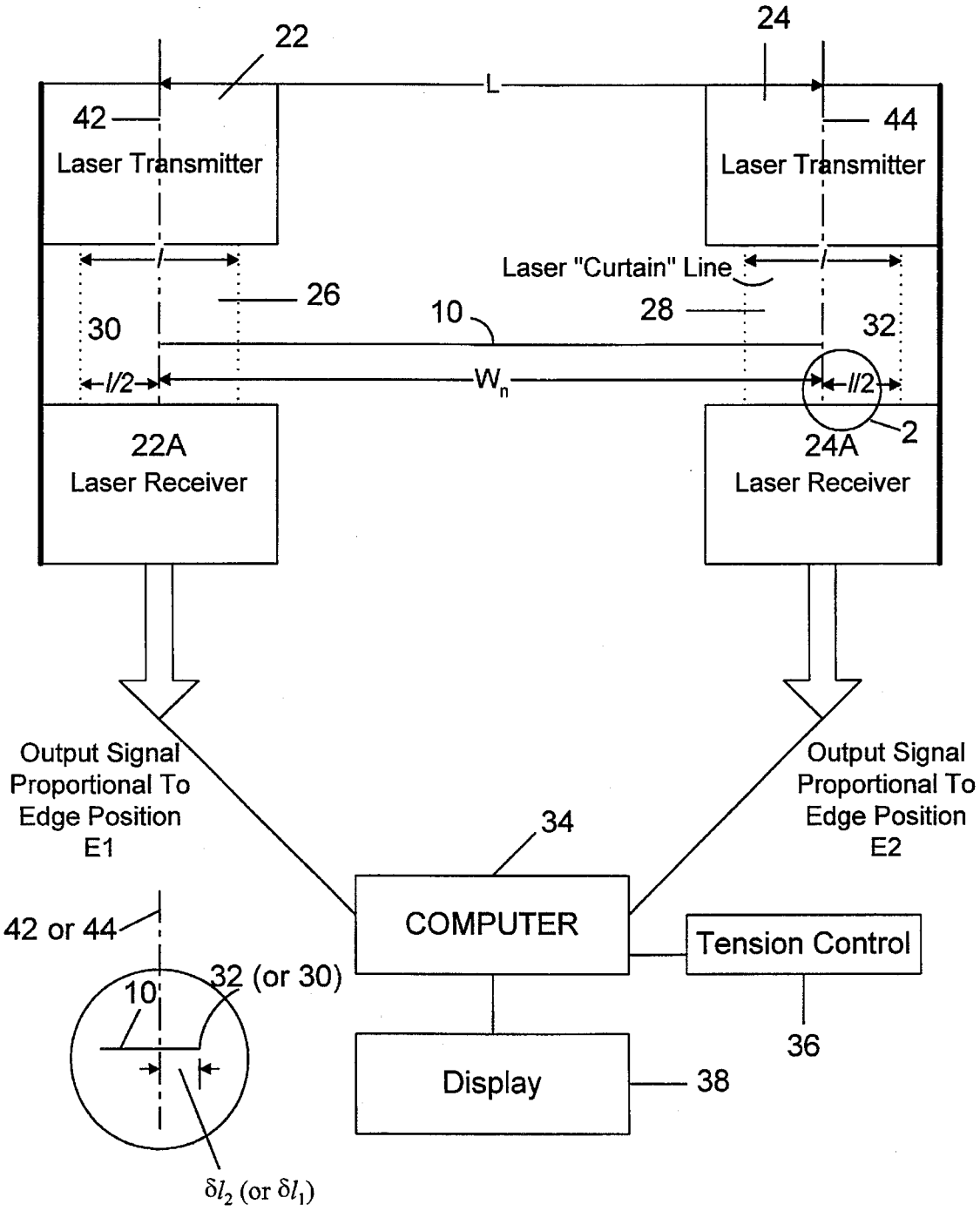
FIG. 2 is a section along the line 2—2 schematically illustrating one of the sensing stations and the equipment associated therewith.
FIG. 2A is a schematic enlargement of the element in the circle 2 of FIG. 2.

As shown in FIG. 2, each of the width sensors 20 includes a pair of laser transmitters 22 and 24 and corresponding receivers 22A and 24A respectively, one positioned at each side edge of the web 10 and preferably set apart by a distance L so that the curtain of laser light 26 and 28 emitted by the transmitters 22 and 24 respectively is each positioned so that substantially half the length of the curtain of light is on one side of the paper edge 30 or 32 and the other half on the opposite side, i.e. outside of the edge 30 or 32, i.e. the length l of each of the lines 26 and 28 laser light substantially bisected at the edges 30 and 32 respectively as indicated by the distances is l/2. Since it is known that the dimension change will result in an increase in width the amount of the laser line 26 or 28 to the outside of the edges 30 or 32 may be significantly more than ½ l.

It will be apparent that the width of the paper web 10 may not be precisely known. The length L may be set so that the nominal width $W_n$ of the incoming paper to the first printing station (station 1) would have its edges 30 or 32 in the positions described. After the first width sensing station in the series obviously the width of the web may be determined and thereafter the sensors could be arranged to be spaced the width of the paper after expansion in the preceding printing station or preferably the width or change in width prior to the printing station in the series after which the width is being sensed will be deducted form the sensed width to obtain the actual change in width attributable to the printing station after which the sensing station is positioned. For example if the width entering the first printing station 1=$W_n$ and the width leaving station 1=$W_1$ and the width leaving station 2=$W_2$ etc. then the change in width after station 1 would be $W_n-W_1=\delta W_1$ ($\delta W$ equals the change in width); $W_2-W_1=\delta W_2$; etc.

It is important that the sensors be able to sense a change in width that is very small in the order of 0.25 mm or less. To be effective, the degree of measuring requirement is relative to the printing applicator being monitored.

The light from the curtains of laser light 26 and 28 not obstructed by the paper as indicated by the distance l/2 in the illustrated arrangement is received in the laser receivers 22A or 24A respectively and each receiver 22A and 24A generates a signal proportional to the amount of light received which permits definition of the position of the end edges 30 and 32 respectively and feeds this signal to a computer 34, which then determines, as desired, the actual width of the paper web 10 or the change in width of the paper web 10 from the nominal or previously determined width of the paper. It is believed this information may then be used to control the process, for example, by adjusting the paper tension which will reduce the width as indicated at 36 in FIG. 2, historically it has been simply displayed as indicated at 38 or both.

Figure 3:
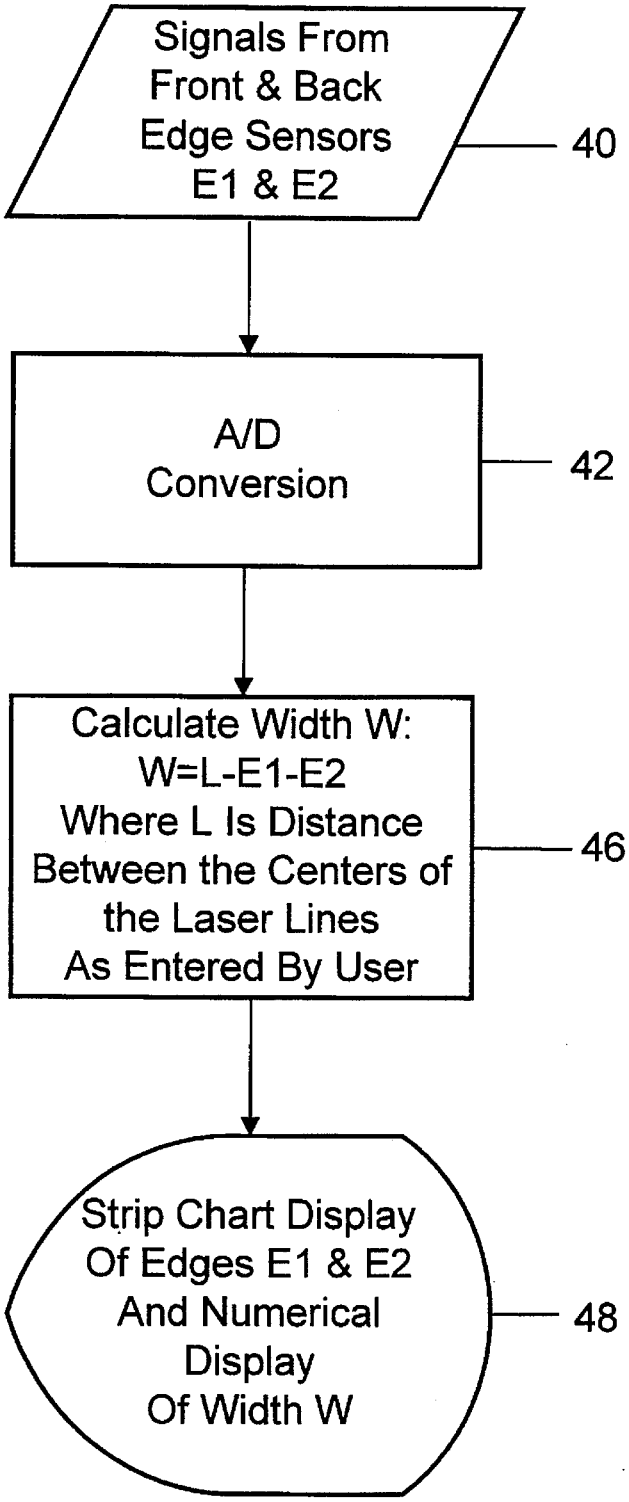
FIG. 3 is a flow diagram of the operation of a sensor used in the present invention.

As indicated in FIG. 3, the signals from the front and back edge sensors 22 and 24 are generated as indicated at 40, separately digitized and converted from analog to digital as indicated at 42 and then the width W of the paper is calculated on the basis of width=$L+\delta l_1+\delta l_2$, where L is the distance between the datums of the two laser lines 26 and 28 for example, the centers of the two laser lines 26 and 28 indicated by the lines 42 and 44, and $\delta l_1$ and $\delta l_2$ are the amounts the paper web edge 30 and 32 respectively extends beyond the datum (center) lines 42 and 44 respectively as indicated by the block 46. This information may then be displayed as indicated at 48 to which is equivalent to the display 38 or as above described, may be used to adjust tension.

The width spacing L between the two datum (center) lines 42 and 44 is manually adjustable by mounting of the laser sensors on the machine frame and thus, will normally be manually entered into the computer, when the actual width of the paper is to be determined. If only the change in width is required, then the two changes in l, i.e. $\delta l_1$ and $\delta l_2$, need only be added to give the total change in dimension, i.e. $\delta l_1+\delta l_2=\delta l$. Obviously, $\delta l_1$ and/or $\delta l_2$ are positive if they are measured outside of the datum lines 42 or 44 and are negative if measured inside of the datum lines 42 or 44.

This system has been found to be extremely useful in printing equipment wherein the web expands laterally as it is printed, for example, in that it permits design of printing plates to correspond exactly with the change in lateral dimension of the sheet or web and thereby better ensures alignment of the various printing operations.

Having described the invention, modifications will be evident to those skilled in the art without departing from the scope of the invention as defined in the appended claims.

We claim:

1. A multi-station printing system wherein a web being printed and passes through a plurality of printing stations arranged in series and wherein said web passing through said stations changes dimensions when subject to a printing operation in each said station, comprising at least one sensor station including a first and a second side edge sensor, means mounting said first side edge sensor on an output side of a first of said printing stations in a position to detect the location of a first side edge of said web relative to a datum as said web travels past said first side edge sensor, means mounting said second side edge sensor on said output side of said first printing station in a position to detect the location of a second side edge of said web relative to a second datum, said second side edge being on the opposite side of said web from said first side edge and means for determining the change in width of said web after it has been printed on in said first printing station based on said sensed locations of said first and said second side edges of said web.

2. A printing system as defined in claim 1 wherein said change in width relative to said datum is determined by adding the components of change in width sensed by said first and said second sensors relative to said datum and said second datum with an increase in web width relative to said datum or said second datum being positive.

3. A printing system as defined in claim 1 wherein one of said sensing stations is provided following each of a plurality of said printing station of said series of printing stations to determine the change of width of said web after each said printing station of said plurality of printing stations.

4. A printing system as defined in claim 2 wherein one of said sensing stations is provided following each of a plurality of said printing station of said series of printing stations to determine the change of width of said web after each said printing station of said plurality of printing stations.

* * * * *